US006255626B1

(12) United States Patent
Endler et al.

(10) Patent No.: US 6,255,626 B1
(45) Date of Patent: Jul. 3, 2001

(54) GLOW PLUG AND PROCESS FOR ITS MANUFACTURE

(75) Inventors: Max Endler; Martin Allgaier, both of Ludwigsburg; Michael Haussner, Benningen; Heinz-Georg Schmitz, Kirchberg; Ulf Wyrwich, Pleidelsheim; Reinhold Grebe, Affalterbach; Hans-Peter Kasimirski; Martin Eller, both of Ludwigsburg, all of (DE)

(73) Assignee: Beru AG, Ludwigsburg (DE)

( * ) Notice: Subject to any disclaimer, the term of this patent is extended or adjusted under 35 U.S.C. 154(b) by 0 days.

(21) Appl. No.: 09/565,475

(22) Filed: May 5, 2000

(30) Foreign Application Priority Data

May 5, 1999 (DE) ..... 19920758

(51) Int. Cl.[7] ..... F23Q 7/00
(52) U.S. Cl. ..... 219/270; 123/145 A
(58) Field of Search ..... 219/270, 544; 123/145 A, 145 R; 361/264–266

(56) References Cited

U.S. PATENT DOCUMENTS 4,475,029 10/1984 Yoshida et al. .
5,922,229 * 7/1999 Kurano ..... 219/270

FOREIGN PATENT DOCUMENTS 41 17 253 12/1991 (DE) .
6-265144 * 9/1994 (JP) .

OTHER PUBLICATIONS

Patent Abstracts of Japan, vol. 007, No. 257 (M–256), Nov. 16, 1983, & JP 58 138928 A (Nippon Tokushu Togyo KK), Aug. 18, 1983, English Abstract.

Patent Abstracts of Japan, vol. 013, No. 311 (M–851), Jul. 17, 1989 & JP 01 102220 A (Nippon Denso CO Ltd), Apr. 19, 1989, English Abstract.

* cited by examiner

*Primary Examiner*—John A. Jeffery
(74) *Attorney, Agent, or Firm*—Nixon Peabody LLP; David S. Safran

(57) ABSTRACT

A glow plug including plug body composed of an electrically insulating plastic material, a heating rod having an inner pole connected to heating elements, and optionally, control elements, and an outer pole which is electrically insulated from adjoining components of the plug body.

13 Claims, 6 Drawing Sheets

GLOW PLUG AND PROCESS FOR ITS MANUFACTURE

BACKGROUND OF THE INVENTION

1. Field of the Invention

The invention relates to glow plugs which have a heating rod with an inner pole with glow and optionally control element(s), the heating rod being electrically insulated relative to the glow plug body, and a process for producing these glow plugs.

2. Description of the Related Art

Making glow plugs with a metal heating rod with an inside pole and with metal glow plug bodies such that between the wall of the heating rod and the glow plug body heat-resistant electrical insulation in the form of a glass seal is inserted is known from general practice. Here the metal glow plug body and the metal heating rod with their respective terminal as well as the glass tubes located between the glow plug body and the heating rod are inserted into a graphite mold and heated in a furnace until the glass melts. The terminals are electrically insulated from one another by ceramic tubes. After cooling and solidification of the molten glass the glow plug body is fixed insulated against the heating rod and the terminals. In this complex production process treatment must take place in a furnace, by which among others also the use of heat-resistant materials is necessary. Construction precision and operating quality cannot be easily ensured in this process, since for example during the process distortion of the components is possible. The just described technical effort of producing glow plugs of this type corresponds to the economic cost.

It has likewise been proposed that at least the heating rod be produced from ceramic material; in doing so in a multistage production process for which special tools and devices are necessary the ceramic must be shaped, compounded, fired and ground into the heating rod. In addition, the ceramic heating rod must be connected to a support tube and can only be built into a finished glow plug in conventional installation.

SUMMARY OF THE INVENTION

The object of the invention is to make available, while circumventing the disadvantages known from the prior art, a glow plug which conventionally can be produced while avoiding special expensive and complex production processes, which makes available a relative large defined electrode, which has high construction precision and functional quality and especially in combined use for ion flow measurement leads to improved and more reliable measurement signals.

DETAILED DESCRIPTION OF THE PREFERRED EMBODIMENT

Figure 1:
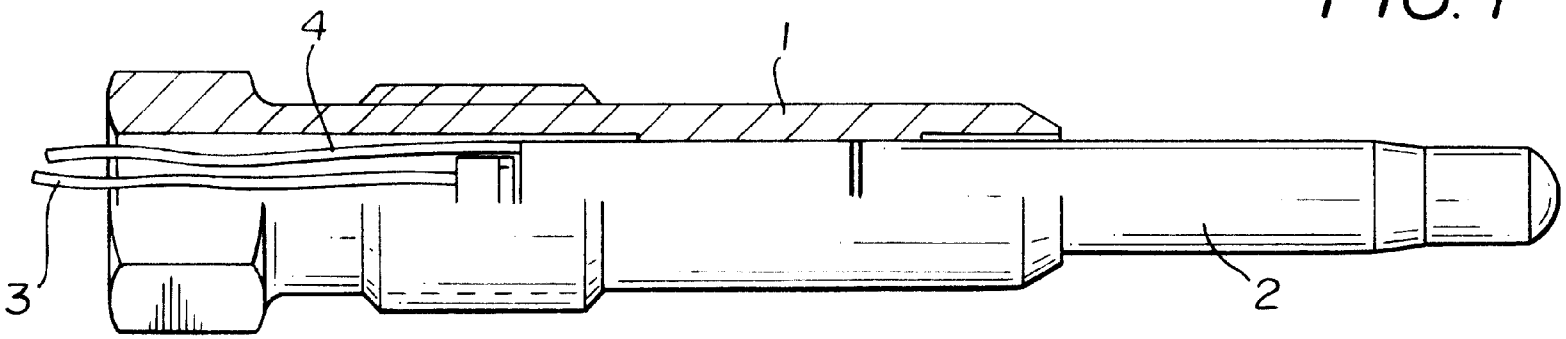
FIG. 1 shows a partial schematic longitudinal section through one embodiment of a glow plug in accordance with the present invention.

As shown in FIG. 1, the embodiment of the glow plug in accordance with the present invention which is shown has a conventional metal glow plug body 1 which however consists of heat-resistant electrically nonconductive plastic material, and with a conventional metal heating rod 2 which is provided conventionally with an inside inner pole (not shown) and heating and optionally control elements connected to it.

In the force fit area of the body 1 on the heating rod 2, grooves, notches, and the like can be formed in the heating rod 2, into which the corresponding fins or the like of the body 1 fit.

The glow plug in accordance with the present invention can be produced for example by pressing the conventional heating rod 2 into the plastic body 1 or by extrusion coating the heating rod 2 with the plastic mass for the body 1.

The terminals 3, 4 with the inner pole or the wall of the heating rod are routed out of the terminal-side end area of the glow plug as cable connections.

Figure 2:
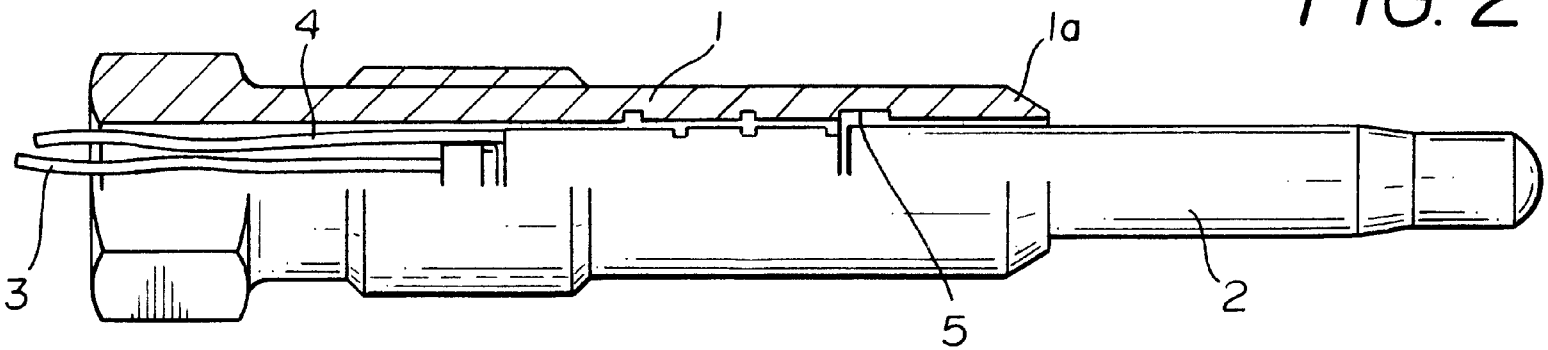
FIG. 2 shows a partially schematic longitudinal section of another glow plug in accordance with the present invention.

The embodiment as shown in FIG. 2 has a metal body 1 and a conventional heating rod 2; between the outside wall of the heating rod 2 and the hole for the heating rod 2 in the body 1 plastic insulation 5, for example of thermoplastic or duroplastic insulating and heat-resistant material, is introduced, in the inner wall of the hole in the heating rod in the body 1 and/or on the outer wall of the heating rod preferably there being grooves or furrows into which the plastic material penetrates especially when the material in the annular gap between the body 1 and the heating rod 2 hardens in the premounted unit consisting of the heating rod 2 and the body 1. Likewise, in this embodiment of the glow plug in accordance with the present invention, the plastic in the contact area to the body 1 can be applied to the heating rod 2 or to the inner wall of the hole in the heating rod in the body 1, whereupon then the heating rod 2 and the body 1 are securely joined to one another by reducing, pressing or drawing in. It can likewise be advantageous to overlap the seal seat 1*a* with the insulation 5, so that the insulation 5 after installation of the plug is additionally fixed between the plug body 1 and the cylinder head. The insulation 5 preferably consists of temperature-resistant plastic with good sealing properties, such as Teflon or Vespel.

Figure 3:
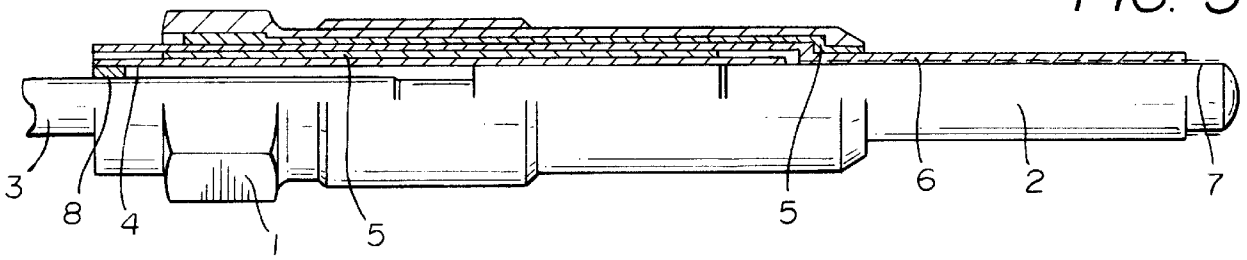
FIG. 3 shows a partially schematic longitudinal section of a glow plug in accordance with the present invention with a separate ion flow measurement sleeve.

The embodiment of the glow plug in accordance with the present invention as shown in FIG. 3 has a separate ion flow measurement sleeve 6 which projects into the combustion area and which is electrically insulated both against the body 1 by insulation 5 and also against the heating rod 2 by insulation 7. The connection of the wall of the heating rod 2 takes place via the terminal 4 in tubular form, one O-ring 8 insulating against the inner pole 3.

The body 1 is fixed for example together with the ion flow measurement sleeve 6 and the tubular outer pole 4 in an injection molding tool, into which then insulating plastic material, for example, a suitable resin or thermoplastic, is introduced, so that it then represents in addition to mechanical fixing, insulation 5 of the ion flow measurement sleeve 6 against the body 1 and also insulation 5 of the ion flow measurement sleeve 6 against the tubular outer pole 4. For this purpose the ion flow measurement sleeve 6 is perforated so that the plastic mass can penetrate into all areas and the enclosed air can escape. In addition, the heating rod 2 in the area of the contact surface to the ion flow measurement sleeve 6 is for example ceramically coated 7. The heating rod 2 can be securely joined via drawing, reducing or rolling to the ion flow measurement sleeve 6. Insulation of the ion flow measurement sleeve 6 relative to the heating rod 2 is ensured by the ceramic coating 7, for example.

Figure 4:
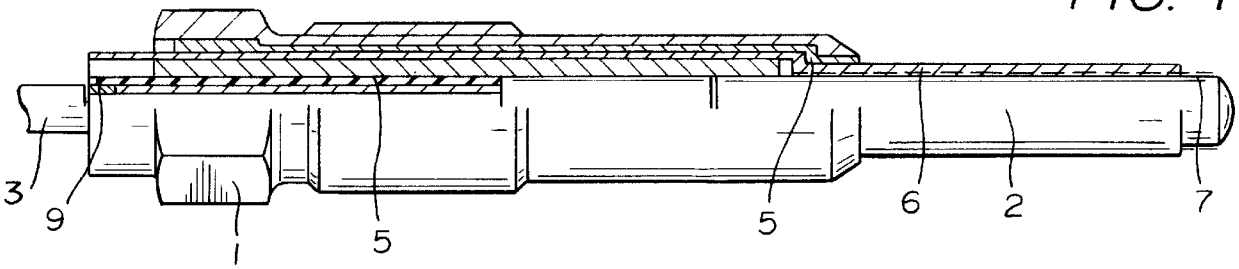
FIG. 4 shows a partially longitudinal section through a modified embodiment of the glow plug in accordance with the present invention as shown in FIG. 3.

Another embodiment in accordance with the present invention is shown in FIG. 4 which corresponds to that as shown in FIG. 3, but the tubular contact tube 4 as the outer pole being omitted, and the tubular wall of the heating rod being routed out of the body as the outer pole connection element 9.

Figure 5:
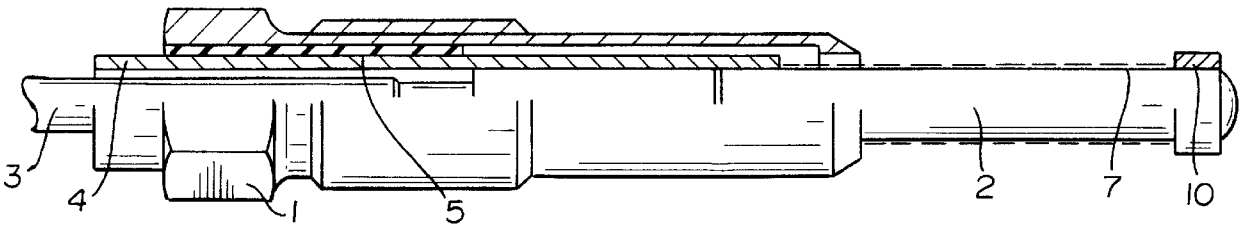
FIG. 5 shows a partially longitudinal section through another embodiment in accordance with the present invention.

FIG. 5 shows another embodiment in accordance with the present invention, a partially electrically insulating ceramic coating 7 being applied to the area of the heating rod 2 emerging from the body 1 as far as for example 5 mm underneath its head end; this head area which represents the actual ignition area can be kept free of coating by covering during the coating process. In this way a defined ion flow electrode is formed in the head area of the heating rod 2, which together with the opposed electrode which is generally the ground of the connected cylinder head forms a defined electrical field, in the influence range of which the ion flow can be acquired. This "shaping" of the electrical field can be supported by attaching for example a molding 10 which is made as a ring and which is attached to the head of the heating rod 2. Alternatively this shaping-on can be also be made integral shaping out of the front area of the heating rod 2.

Figure 6:
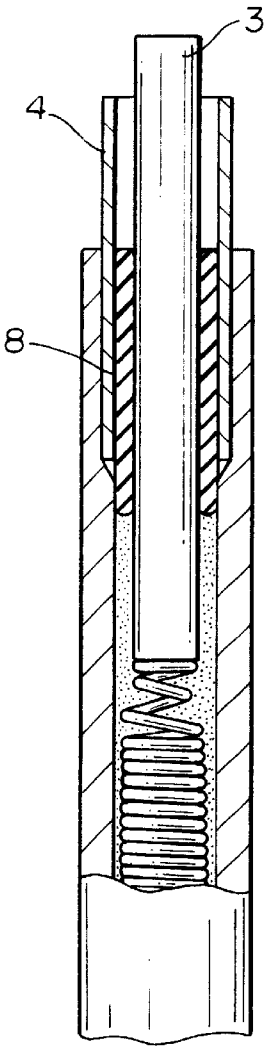
FIG. 6 shows a longitudinal section through the terminal-side end area of the heating rod of one embodiment of the glow plug in accordance with the present invention.

FIG. 6 shows a novel connection variation, especially for glow plugs in accordance with the present invention, in which connection of the heating rod 2 takes place via a contact tube 4, this contact tube 4 being inserted into a hole of the end area of the heating rod 2; to seal the interior of the heating rod 2 there is an O-ring 8 which together with the contact tube 4 is inserted or reduced in the terminal-side end area of the heating rod 2.

Figure 7:
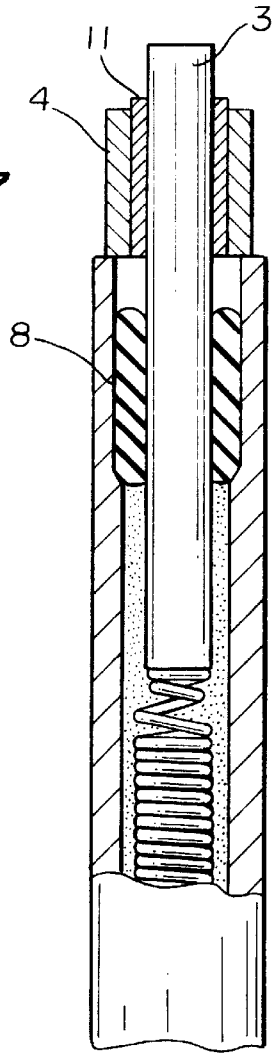
FIG. 7 shows a partially longitudinal section through the terminal-side end area of the heating rod of another embodiment of the glow plug in accordance with the present invention.

In another configuration of the heating rod termination in accordance with the present invention, as shown in FIG. 7 a contact tube 4 is fixed concentrically on the end face of the terminal-side end area of the heating rod 2, for example by pulse welding; between the contact tube 4 and the inner pole 3 there is insulation 11 in the form of an insulating tube or an insulating compound, for example MgO; the O-ring 8 in turn insulates and fixes the inner pole 3 relative to the heating rod 2 and at the same time seals the interior of the heating rod 2.

Figure 8:
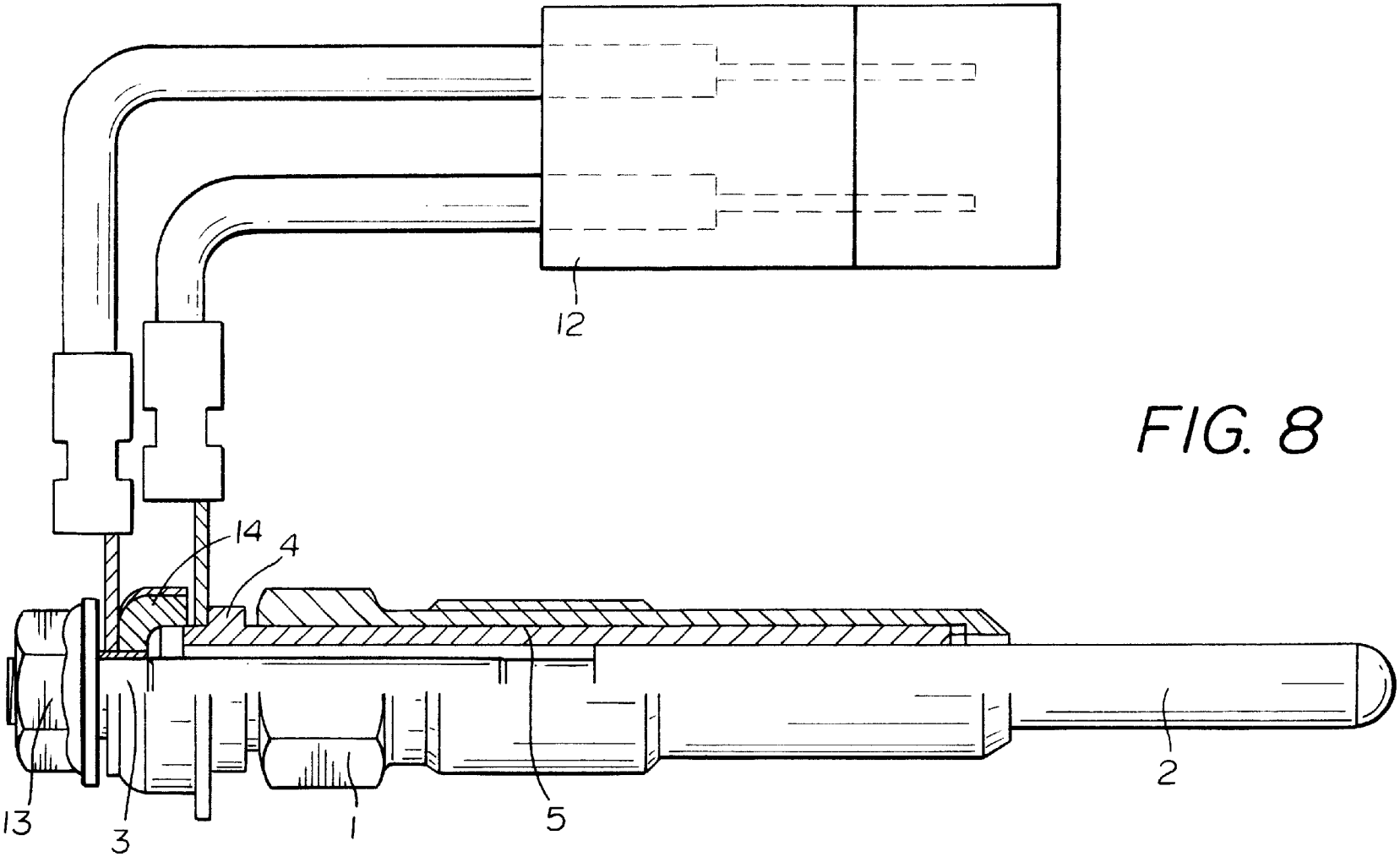
FIG. 8 shows schematic of the terminal area of another embodiment in accordance with the present invention.

As shown in FIG. 8, via the screw connection 14 which has already been used in series and which is attached to the nut 13 a double-pin or multipin plug 12 can be connected to a glow plug, in which the connection of the inner pole 3 like a conventional inner pole is made with a threaded termination and the connection of the heating rod 2 is made as a metal tube which projects over the body 1 with a collar.

Figure 9:
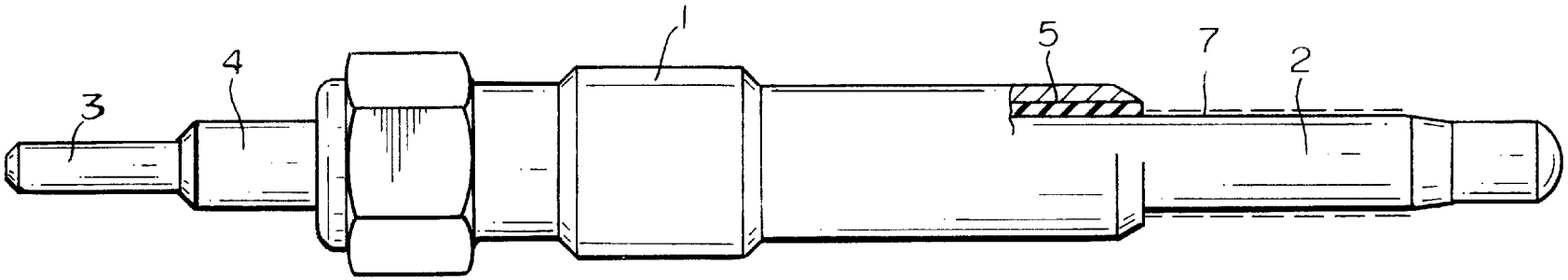
FIG. 9 shows a partial cross section through another embodiment of the glow plug in accordance with the present invention.

As shown in FIG. 9, another embodiment of the glow plug in accordance with the present invention has an insulating, heat-resistant layer 7, for example, of ceramic, in the area of the part of the heating rod 2 projecting into the combustion space and preferably adjoins the insulation 5 between the heating rod 2 and the body 1. But this layer does not overlap the tip of the heating rod, for example over an area of roughly 5 to 10 mm, to the extent it forms the actual ignition area. This results in that the danger of shunting is prevented by reducing or preventing soot formation on the temperature-resistant insulating layer 24. Measurement signals, for example with respect to the ion flow, can be taken via the cylinder head from the uninsulated tip area of the heating rod 2 which forms the actual ignition area; in this area the soot is burned off as a result of the ambient temperature or the temperature of the heating rod during glow operation.

Figure 10:
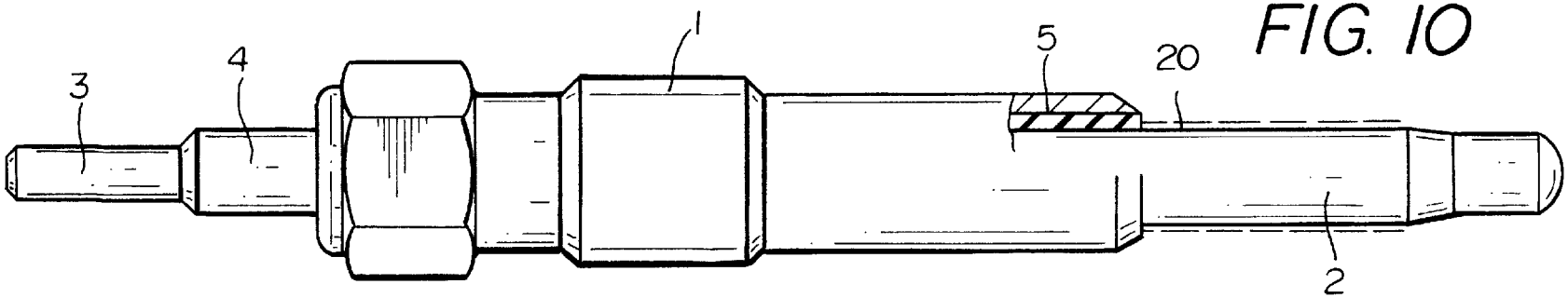
FIG. 10 shows a partial cross section through another embodiment of the glow plug in accordance with the present invention.

In the corresponding manner as in the embodiment shown in FIG. 9, in another embodiment as shown in FIG. 10, instead of the ceramic layer, a catalytic layer 20 is applied which catalyzes the burn-off of the soot layer in this area of the heating rod with a lower temperature; suitable components of one such catalytic layer 20 can be platinum or palladium or their heat-resistant compounds or alloys.

Figure 11:
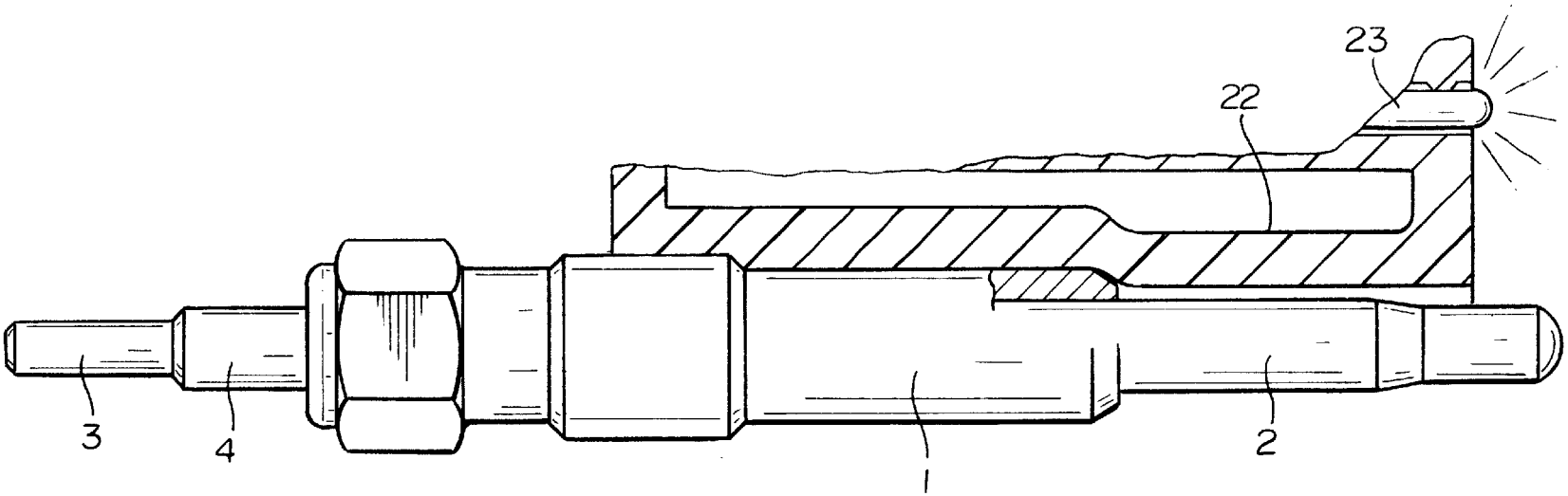
FIG. 11 shows a schematic partially longitudinal section through one arrangement with the glow plug in accordance with the present invention.

An arrangement in accordance with the present invention as shown in FIG. 11 has a glow plug in accordance with the present invention, the plug being located in the cylinder head 22 of ceramic or another insulating temperature-resistant material and the ion flow can be measured for example between the heating rod 2 and the injector 23.

The advantages in accordance with the present invention consist in the simple production process which is suitable for mass production and into which the production conventional to date can be integrated; the glow plugs in accordance with the present invention are characterized by small deviations of shape and bearing of the components, especially of the inner pole, and the different components and construction materials such as the scaling components and insulating compounds can be adapted to the various operating temperatures of the respective glow plug area; at the same time the glow plugs in accordance with the present invention in their combustion space-side area make available an insensitive, large-area electrode, and more accurate and more reliable ion flow measurement signals can be attained. At the same time the tubularly made coaxial connections allow simple terminals, especially of the inner pole.

What is claimed is:

1. Glow plug comprising a plug body and a heating rod, into which an inner pole, connected to heating elements and control elements, leads, and with an outer pole, the outer pole being the wall of a heating rod which is electrically insulated from adjacent components of the plug body, wherein the plug body comprises an electrically insulating plastic material.

2. Glow plug as claimed in claim 1, wherein the electrical insulation in the force fit area between the body and the heating rod comprises a coating of electrically insulating plastic on the heating rod or on the wall of a hole of the plug body adjoining the heating rod.

3. Glow plug as claimed in claim 1 or 2, wherein in the terminal-side area the electrical connection to the wall of the heating rod comprises a tube section as a contact tube, said tube section having one end located in a matched hole in the end area of the wall of the heating rod, an O-ring sealing the interior of the heating rod and at the same time electrically insulating the contact tube against the inner pole.

4. Glow plug as claimed in claim 1 or 2, wherein in the terminal-side end area of the heating rod a contact tube is fixed and is electrically insulated relative to an inner pole which extends through the contact tube by introduced electrically insulating material, and further including an O-ring for sealing the interior of the heating rod and for electrically insulating positioning of the inner pole.

5. Glow plug as claimed in claim 4, further comprising a separate ion flow measurement sleeve disposed concentrically around the area of the heating rod projecting into the combustion space, said sleeve insulated both from the plug body and also from the heating rod, the insulation against the heating rod formed on the contact area of the ion flow measurement sleeve with the heating rod having a coating of heat-resistant electrically insulating plastic material or ceramic material.

6. Glow plug as claimed in claim 5, wherein the area of the heating rod projecting into the combustion space, exclusive of the tip of the heating rod as the ignition area, is coated with a heat-resistant electrically insulating plastic material or ceramic material.

7. Glow plug as claimed in claim 6, wherein the area of the heating rod projecting into the combustion space, exclusive of the tip of the heating rod as the ignition area, is provided with a layer comprising a catalytic material for preventing the formation of a layer of soot.

8. Process for producing a glow plug with an insulated heating rod, wherein a heating rod is connected to a plug body by extrusion coating with electrically insulating plastic material.

9. Process for producing a glow plug with an insulated heating rod, wherein the heating rod is pressed into a prefabricated plastic plug body.

10. Process for producing a glow plug with an insulated heating rod, wherein electrically insulating plastic is introduced into an annular gap between the heating rod and a metal plug body.

11. The process for producing a glow plug with an insulated heating rod as claimed in claim 10, wherein plastic is introduced in liquid or powder form and hardened.

12. The process for producing a glow plug with an insulated heating rod as claimed in one of claims 8 to 11, wherein the connection to the plug body is established by a contact tube which adjoins the inner pole with an interposed O-ring.

13. The process for producing a glow plug with an insulated heating rod as claimed in claim 12, wherein insulation is disposed between the inner pole and the plug body in a terminal-side area by an O-ring, while the contact tube on the terminal-side end area of the plug body is fixed and wherein insulation including an O-ring or an insulating compound is disposed between the contact tube and the inner pole.

* * * * *